US006871636B2

(12) United States Patent
Boecking

(10) Patent No.: US 6,871,636 B2
(45) Date of Patent: Mar. 29, 2005

(54) FUEL-INJECTION DEVICE FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/399,659

(22) PCT Filed: Jul. 5, 2002

(86) PCT No.: PCT/DE02/02463

§ 371 (c)(1),
(2), (4) Date: Feb. 22, 2004

(87) PCT Pub. No.: WO03/018995

PCT Pub. Date: Mar. 6, 2003

(65) Prior Publication Data

US 2004/0055573 A1 Mar. 25, 2004

(30) Foreign Application Priority Data

Aug. 22, 2001 (DE) ..... 101 41 110

(51) Int. Cl.[7] ..... F02M 57/02; F02M 47/02; F02M 59/10; F02M 59/46

(52) U.S. Cl. ..... 123/467; 123/446; 123/506; 239/533.2; 239/533.3; 239/585.5

(58) Field of Search ..... 123/446, 467, 123/506, 500, 501; 239/533.2, 533.3, 533.9, 585.1, 585.3, 585.5, 88–90

(56) References Cited

U.S. PATENT DOCUMENTS

| | | | | | |
|---|---|---|---|---|---|
| 4,074,668 | A | * | 2/1978 | Indra | 417/242 |
| 5,893,350 | A | * | 4/1999 | Timms | 123/467 |
| 6,637,409 | B2 | * | 10/2003 | Brenk et al. | 123/467 |
| 2003/0089802 | A1 | * | 5/2003 | Mahr et al. | 239/533.2 |

FOREIGN PATENT DOCUMENTS

| | | |
|---|---|---|
| DE | 199 39 448 A | 3/2001 |
| DE | 199 56 598 A | 6/2001 |
| DE | 100 02 702 A | 8/2001 |
| DE | 100 08 268 A | 8/2001 |

* cited by examiner

*Primary Examiner*—Weilun Lo
(74) *Attorney, Agent, or Firm*—Ronald E. Greigg

(57) ABSTRACT

A fuel injection system for internal combustion engines includes a plurality of injection valves, each connected to an injection line and each having a nozzle chamber and a control chamber, which both communicate with the injection line; a valve member, which controls the injection openings and is actuatable via a first control face, located in the nozzle chamber and acting in the valve opening direction, and via a second control face located in the control chamber and acting in the valve closing direction; a first valve for controlling the pressure prevailing in the control chamber; and a second valve for switching the injection pressure. Both valves, have a common valve body with the valve body stroke $H_2$ required to close the first valve being greater than the stroke $H_1$ required to open the second valve.

19 Claims, 2 Drawing Sheets

FUEL-INJECTION DEVICE FOR INTERNAL COMBUSTION ENGINES

CROSS-REFERENCE TO RELATED APPLICATIONS

This application is a 35 USC 371 application of PCT/DE 02/02463 filed on Jul. 5, 2002.

BACKGROUND OF THE INVENTION

1. Field of the Invention

The invention is directed to an improved fuel injection system for internal combustion engines.

2. Description of the Prior Art

In a known fuel injection system (German Patent Disclosure DE 199 10 970 A1), the control chamber can be made to communicate with a relief line via a 2/2-way valve. Another 2/2-way valve serves to activate a pressure booster, with which a high injection pressure is generated.

SUMMARY OF THE INVENTION

The fuel injection system of the invention has the advantage over the prior art that the common valve is actuatable by a single actuator drive, making for a savings of one valve body and one actuator drive for each injector.

Preferably, the valve for controlling the pressure prevailing in the control chamber is embodied as a slide valve, and the valve for switching the injection pressure is embodied as a seat valve.

BRIEF DESCRIPTION OF THE DRAWINGS

The fuel injection system of the invention is described in further detail herein below, with reference to the drawings, in which.

DESCRIPTION OF THE EXEMPLARY EMBODIMENTS

Figure 1:
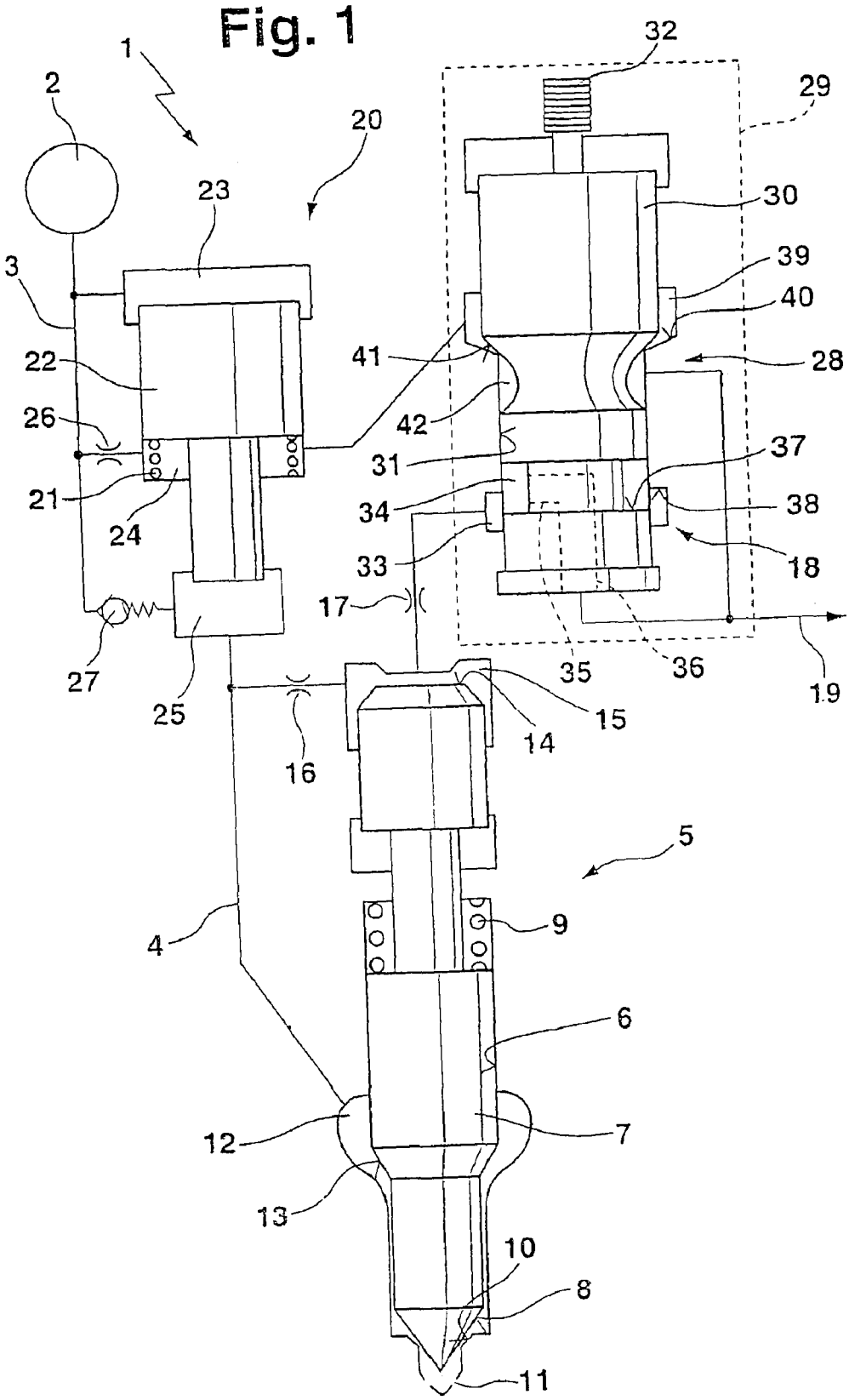
FIG. 1 schematically shows the essential components of a fuel injection system of the invention, with a 4/3-way control valve for controlling the injection event.

The fuel injection system 1 for internal combustion engines, shown in FIG. 1, includes a high-pressure reservoir 2 (common rail), in which fuel is stored at a fuel pressure P1. From the high-pressure reservoir 2, the fuel is carried away via respective pressure lines 3 and injection lines 4 to the individual injection valves (injectors) 5, protruding into the combustion chamber of the internal combustion engine to be supplied; of these injectors, only one is shown in FIG. 1.

In an axial guide bore 6 of the injection valve 5, a pistonlike valve member (nozzle needle) 7 with a conical valve sealing face 8 is displaceably supported; it is pressed by a closing spring 9 against a conical valve seat face 10 of the valve housing and closes the injection openings 11 that are provided there. In the injection valve 5, the injection line 4 discharges into an annular nozzle chamber 12, from which an annular gap, extending between the guide bore 6 and the valve member 7, leads as far as the valve seat face 10. In the region of the nozzle chamber 12, the valve member 7 has a first control face 13, embodied as a pressure shoulder, at which the fuel delivered via the injection line 4 engages the valve member 7 in the opening direction (that is, inward). The face end of the valve member 7 remote from the valve sealing face 8 forms a second control face 14, which defines a control chamber 15 and acts in the valve closing direction. The control chamber 15 communicates with the injection line 4 via an inflow throttle 16 and can be made to communicate, via an outflow throttle 17 and a slide valve 18, with a relief line (leak fuel) 19. The second control face 14 is larger than the first control face 13, so that when the slide valve 18 is closed, that is, when there is equal pressure in the nozzle chamber 12 and in the control chamber 15, the valve member 7 closes the injection openings 11. The inflow throttle 16 is smaller than the outflow throttle 17, so that when the slide valve 18 is open, the pressure prevailing in the control chamber 15 is reduced via the relief line 19 and, above an opening pressure $P_s$, the valve member 7 is opened by the pressure prevailing in the nozzle chamber 12, counter to the action of the closing spring 9.

For each injection valve 5, one local pressure booster unit 20 is provided, with a booster piston 22 which is axially displaceable counter to the action of a restoring spring 21 and which on its primary side defines a primary chamber 23, on its secondary side defines a secondary chamber 24, and on the pressure side defines a pressure chamber 25. The primary chamber 23 communicates directly with the pressure line 3; the secondary chamber 24 communicates with line 3 via a throttle 26; and the pressure chamber 25 communicates via a check valve 27 with the pressure line 3, and the injection line 4 leads away from the pressure chamber 25. Via a seat valve 28, the secondary chamber 24 can be made to communicate with the relief line 19. When the switching valve 28 is closed, the fuel pressure P1 of the pressure reservoir 2 prevails in all three chambers 23, 24, 25, so that the booster piston 22 is pressed into its outset position by the restoring spring 21. If the secondary chamber 24 is pressure-relieved by the opening of the seat valve 28, the booster piston 22 is displaced in the compression direction; as a result, a function of the ratio of piston cross sections in the primary and pressure chamber 23, 25, the fuel in the pressure chamber 25 is compressed to a higher fuel pressure. The check valve 27 prevents the return flow of compressed fuel back into the pressure line 3.

The slide valve 18 and the seat valve 28 are combined into a 4/3-way control valve 29 with a common valve body 30. The valve body 30 is supported displaceably in an axial guide bore 31 of the valve housing and is axially adjustable by means of a piezoelectric actuator drive 32.

On the inlet side, the slide valve 18 has a lower annular chamber 33, provided in the wall of the guide bore 29, and the line originating at the control chamber 15 discharges into this annular chamber. On the outlet side, the slide valve 18 has a lower annular chamber 34, which is provided on the valve body 30 and opens toward the annular chamber 33. Via transverse bore 35 and a longitudinal bore 36 of the valve body 30, the lower annular chamber 34 of the valve body 30 communicates with the relief line 19 that begins at the face end of the guide bore 31. The slide valve 18 blocks the flow from chamber 34 to line 19 when the control edge 37 of the annular chamber 34, upon a stroke $H_2$ of the valve body 30, overtakes the upper sealing edge 38 of the annular chamber 33

The seat valve 28, on the inlet side, has an upper annular chamber 39, which is provided in the wall of the guide bore 31 and has a conical valve seat face 40 into which the line leading away from the secondary chamber 24 discharges. The valve body 30 has a conical valve sealing face 41, cooperating with the valve seat face 40, and the valve sealing face widens toward the bottom to form an annular chamber 42, from which the relief line 19 leads away.

In the outset position, shown in FIG. 1, of the 4/3-way control valve 29, the slide valve 18 is opened, so that the control chamber 15 is pressure-relieved, and the seat valve 28 is closed, so that the secondary chamber 24 is not pressure-relieved. The stroke $H_1$ of the valve body 30 required to open the seat valve 28 is shorter than the stroke $H_2$ required to close the slide valve 18.

Figure 2:
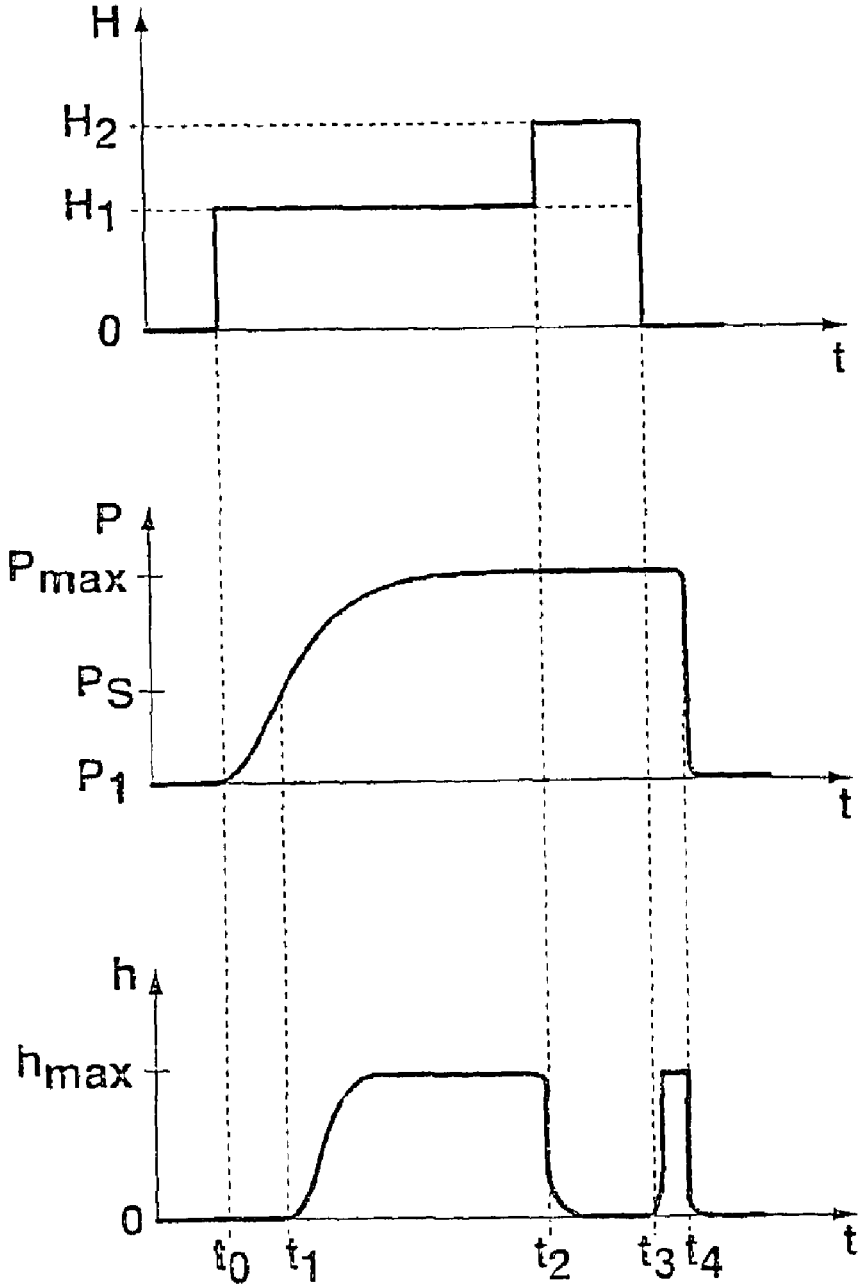
FIG. 2 is a graph, which for the fuel injection system shown in FIG. 1 shows the stroke (H) of the valve body of the 4/3-way control valve, the injection pressure (P), and the stroke (h) of the valve member of the injection valve, plotted over the time axis.

In FIG. 2, the chronological sequence of an injection event is plotted in a graph.

The onset of the injection event is initiated at time t0 by a stroke $H_1$ of the valve body 30, so that the seat valve 28 opens, and the slide valve 18 remains open. The secondary chamber 24 is pressure-relieved, and a higher fuel pressure builds up in the pressure chamber 25 and thus also in the nozzle chamber 12.

When at time t1 the opening pressure $P_s$ is reached in the nozzle chamber 12, the valve member 7 opens under pressure control, counter to the action of the closing spring 9, and is opened at the maximum stroke $h_{max}$, so that the injection takes place at the fuel pressure prevailing in the nozzle chamber 12. The maximum injection pressure $P_{max}$ is the result of the piston cross-sectional ratio of the primary and pressure chambers 23, 25.

At time t2, at which the pressure prevailing the nozzle chamber 12 is still higher than the opening pressure $P_s$, the slide valve 18 is closed by a stroke $H_2$ of the valve body 30. The control chamber 15 is no longer pressure-relieved, and the pressure in the control chamber 15 rises, so that the valve member 7 closes the injection openings 11 under stroke control.

At time t3, by restoring the valve body 30 to its outset position, the slide valve 18 is opened and the seat valve 28 is closed. The control chamber 15 is pressure-relieved again, and the valve member 7 opens under stroke control, so that a postinjection takes place, with the fuel pressure, such as $P_{max}$, that prevails in the injection chamber 12.

The injection event is ended at time t4, when the fuel pressure prevailing in the nozzle chamber 12 becomes less than the opening pressure $P_s$. Because the secondary chamber 24 is no longer pressure-relieved, the booster piston 22 is pressed into its outset position by the restoring spring 21, and the pressure chamber 25 fills with fuel from the pressure reservoir 2.

The foregoing relates to preferred exemplary embodiments of the invention, it being understood that other variants and embodiments thereof are possible within the spirit and scope of the invention, the latter being defined by the appended claims.

I claim:

1. A fuel injection system (1) for internal combustion engines, comprising a plurality of injection valves (5), each provided in an injection line (4) for the fuel, each injection valve (5) having a nozzle chamber (12) and a control chamber (15), which both communicate with the injection line (4);

a valve member (7), which controls the injection openings (11) of the nozzle chamber (12) and which is actuatable via a first control face (13), located in the nozzle chamber (12) and acting in the valve opening direction, and via a second control face (14), located in the control chamber (15) and acting in the valve closing direction;

a first valve (18) for controlling the pressure prevailing in the control chamber (15);

a second valve (28) for switching the injection pressure, the valves (18, 28) having one common valve body (30) and the stroke $(H_2)$ of the valve body (30) required to close the first valve (18) being greater than the stroke $(H_1)$ required to open the second valve (28).

2. The fuel injection system of claim 1, wherein the first valve (18) is embodied as a slide valve.

3. The fuel injection system of claim 1, wherein the second valve (28) is embodied as a seat valve.

4. The fuel injection system of claim 2, wherein the second valve (28) is embodied as a seat valve.

5. The fuel injection system of claim 1, wherein the actuator drive provided for the valve body (30) is embodied as a piezoelectric actuator drive (32).

6. The fuel injection system of claim 2, wherein the actuator drive provided for the valve body (30) is embodied as a piezoelectric actuator drive (32).

7. The fuel injection system of claim 3, wherein the actuator drive provided for the valve body (30)is embodied as a piezoelectric actuator drive (32).

8. The fuel injection system of claim 4, wherein the actuator drive provided for the valve body (30) is embodied as a piezoelectric actuator drive (32).

9. The fuel injection system of claim 1, further comprising a central pressure reservoir (2) in which at least one lower fuel pressure (P1) is stored.

10. The fuel injection system of claim 2, further comprising a central pressure reservoir (2) in which at least one lower fuel pressure (P1) is stored.

11. The fuel injection system of claim 3, further comprising a central pressure reservoir (2) in which at least one lower fuel pressure (P1) is stored.

12. The fuel injection system of claim 4, further comprising a central pressure reservoir (2) in which at least one lower fuel pressure (P1) is stored.

13. The fuel injection system of claim 5, further comprising a central pressure reservoir (2) in which at least one lower fuel pressure (P1) is stored.

14. The fuel injection system of claim 1, wherein the injection line (4) communicates both with a lower fuel pressure (P1) via a check valve (27) and with the pressure chamber (25) of a pressure booster unit (20) which is activatable by the second valve (28).

15. The fuel injection system of claim 2, wherein the injection line (4) communicates both with a lower fuel pressure (P1) via a check valve (27) and with the pressure chamber (25) of a pressure booster unit (20) which is activatable by the second valve (28).

16. The fuel injection system of claim 3, wherein the injection line (4) communicates both with a lower fuel pressure (P1) via a check valve (27) and with the pressure chamber (25) of a pressure booster unit (20) which is activatable by the second valve (28).

17. The fuel injection system of claim 4, wherein the injection line (4) communicates both with a lower fuel pressure (P1) via a check valve (27) and with the pressure chamber (25) of a pressure booster unit (20) which is activatable by the second valve (28).

18. The fuel injection system of claim 5, wherein the injection line (4) communicates both with a lower fuel pressure (P1) via a check valve (27) and with the pressure chamber (25) of a pressure booster unit (20) which is activatable by the second valve (28).

19. The fuel injection system of claim 9, wherein the injection line (4) communicates both with a lower fuel pressure (P1) via a check valve (27) and with the pressure chamber (25) of a pressure booster unit (20) which is activatable by the second valve (25).

* * * * *

UNITED STATES PATENT AND TRADEMARK OFFICE

CERTIFICATE OF CORRECTION

PATENT NO. : 6,871,636 B2
DATED : March 29, 2005
INVENTOR(S) : Friedrich Boecking It is certified that error appears in the above-identified patent and that said Letters Patent is hereby corrected as shown below:

Title page,
Item [86], PCT No, should read -- [86] PCT No.: PCT/DE02/02463
§ 371 (c)(1),
(2), (4) Date: October 6, 2003 --

Signed and Sealed this

Thirty-first Day of May, 2005

JON W. DUDAS
*Director of the United States Patent and Trademark Office*